US008091146B1

(12) United States Patent
Anhalt et al.

(10) Patent No.: US 8,091,146 B1
(45) Date of Patent: Jan. 10, 2012

(54) REMOVABLE GARMENT LINING

(76) Inventors: Pamela S. Anhalt, Verona, WI (US); Karl L. Fels, Verona, WI (US)

( * ) Notice: Subject to any disclaimer, the term of this patent is extended or adjusted under 35 U.S.C. 154(b) by 1004 days.

(21) Appl. No.: 12/001,653

(22) Filed: Dec. 12, 2007

Related U.S. Application Data

(60) Provisional application No. 60/877,450, filed on Dec. 28, 2006.

(51) Int. Cl.
*A41D 1/06* (2006.01)

(52) U.S. Cl. ..... 2/227; 2/272

(58) Field of Classification Search ..... 2/71, 79, 2/227, 228, 272, 234, 2, 3.6
See application file for complete search history.

(56) References Cited

U.S. PATENT DOCUMENTS

| | | | | | |
|---|---|---|---|---|---|
| 238,574 | A | * | 3/1881 | Clyde | 2/227 |
| 1,976,126 | A | * | 10/1934 | Hickerson | 2/79 |
| 2,132,117 | A | * | 10/1938 | Korolick | 2/228 |
| 2,138,230 | A | * | 11/1938 | Friedman | 2/71 |
| 2,166,088 | A | * | 7/1939 | Boetcker | 2/234 |
| 2,166,514 | A | * | 7/1939 | Zapis | 2/67 |
| 2,264,958 | A | * | 12/1941 | Smith | 2/227 |
| 2,503,501 | A | * | 4/1950 | Lutz | 150/106 |
| 2,515,557 | A | * | 7/1950 | Haswell | 294/3.6 |
| 2,519,202 | A | * | 8/1950 | Slater | 2/234 |
| 2,531,805 | A | * | 11/1950 | Clark | 294/3.6 |
| 2,663,876 | A | * | 12/1953 | Miller et al. | 2/227 |
| 2,811,763 | A | * | 11/1957 | Jordan | 294/3.6 |
| 2,835,952 | A | * | 5/1958 | Mininberg | 294/3.6 |
| 2,867,880 | A | * | 1/1959 | O'Hanlon | 294/3.6 |
| 2,900,205 | A | * | 8/1959 | Cirone | 294/3.6 |
| 2,908,057 | A | * | 10/1959 | Blanco | 24/3.13 |
| 3,006,051 | A | * | 10/1961 | Maeder | 294/3.6 |
| 3,115,641 | A | * | 12/1963 | Rea | 2/227 |
| 3,599,274 | A | * | 8/1971 | Donovan | 294/3.6 |
| 4,022,506 | A | * | 5/1977 | Cloud, Sr. | 294/3.6 |
| 4,282,608 | A | * | 8/1981 | Amberg | 2/227 |
| 4,386,438 | A | * | 6/1983 | Evin | 2/272 |
| 4,554,684 | A | * | 11/1985 | Cadoret | 2/227 |
| 4,578,828 | A | * | 4/1986 | Smith et al. | 2/234 |
| 4,914,756 | A | * | 4/1990 | Grassick | 2/227 |
| 4,918,760 | A | * | 4/1990 | Grilliot et al. | 2/227 |
| 5,008,962 | A | * | 4/1991 | Smith et al. | 2/234 |
| 5,010,595 | A | * | 4/1991 | Stradley | 2/227 |
| 5,664,256 | A | * | 9/1997 | Blauer et al. | 2/69 |
| 5,898,934 | A | * | 5/1999 | Hunter et al. | 2/2.15 |
| 5,983,401 | A | * | 11/1999 | Ohara | 2/227 |
| 6,108,815 | A | * | 8/2000 | Majerfeld | 2/71 |
| 6,161,223 | A | * | 12/2000 | Andrews | 2/234 |
| 6,243,878 | B1 | * | 6/2001 | Khemka et al. | 2/227 |

(Continued)

*Primary Examiner* — Katherine Moran
*Assistant Examiner* — Richale Quinn
(74) *Attorney, Agent, or Firm* — Tipton L. Randall

(57) ABSTRACT

A removable liner assembly for pants includes first and second separating liner members joined together. Separating torso covering sections are joined to form an entry opening by a separating zipper assembly having a zipper section secured to each torso covering section of the liner member. A zipper slide member secured to one zipper section engages and disengages the zipper sections. A pull cord member fastened to the zipper slide member is anchored to the torso covering section, near the box end of the zipper section containing the zipper slide member. The zipper sections are disengaged with the pull cord member. An individual wearing the removable liner assembly beneath a pair of pants disengages the separating zipper assembly by pulling the cord member. This separates the first and second liner members. The individual removes each liner member from within the pants through the foot exit openings.

25 Claims, 9 Drawing Sheets

U.S. PATENT DOCUMENTS

| | | | | |
|---|---|---|---|---|
| 6,305,027 | B2 * | 10/2001 | Chou | 2/227 |
| 6,490,734 | B2 * | 12/2002 | Blauer et al. | 2/87 |
| 6,691,317 | B2 * | 2/2004 | Cochran | 2/97 |
| 6,949,001 | B1 * | 9/2005 | Brewer, Jr. | 446/369 |
| 7,849,522 | B2 * | 12/2010 | Roux | 2/227 |
| 7,926,122 | B1 * | 4/2011 | Countryman | 2/227 |
| 2002/0059674 | A1 * | 5/2002 | Blauer et al. | 2/87 |
| 2005/0251896 | A1 * | 11/2005 | Donlan et al. | 2/269 |
| 2006/0174399 | A1 * | 8/2006 | Nikolayev et al. | 2/227 |

* cited by examiner

REMOVABLE GARMENT LINING

CROSS-REFERENCE TO RELATED APPLICATIONS, IF ANY

This application claims the benefit under 35 U.S.C. §119 (e) of provisional application Ser. No. 60/877,450, filed 28 Dec. 2006. Application Ser. No. 60/877,450 is hereby incorporated by reference.

STATEMENT REGARDING FEDERALLY SPONSORED RESEARCH OR DEVELOPMENT

Not applicable.

REFERENCE TO A MICROFICHE APPENDIX, IF ANY

Not applicable.

BACKGROUND OF THE INVENTION

1. Field of the Invention

The present invention relates to a lining for a garment and, more particularly, to a removable lining for a garment and, most particularly, to a removable lining for a pair of trousers or pants.

2. Background Information

When an individual participates in various outdoor activities, it is often necessary to wear some type of protective clothing, particularly when the outside temperature is cool or cold. This is particularly true when an individual performs exercises or participates in outdoor sports. These individuals often wear pants or trousers to provide warmth to the wearer's lower torso and legs. In colder temperatures, the pants or trousers can be fabricated from materials that provide more warmth for added protection. However, as the individual "warms up," and/or the temperature gets warmer, the heavy material becomes uncomfortable. The terms "pants" and "trousers" are understood to designate a covering for each individual leg and lower torso. The term "pants" will be used hence forth, with the understanding that the term is equivalent to "trousers."

In order to overcome this problem, the individual can wear several pairs of pants, one on top of the other. The outer pants are often decorative, for example, with a particular logo or prominent color. The inner pants, termed liners, can be plain and offer a pleasing texture to the skin of the wearer. However, in order to remove the pants liner when the wearer warms up, and/or it gets warmer outside, or the individual goes inside after an activity, the wearer must remove both the outer pants and inner liner, then put the outer pants back on. Such a process is cumbersome and requires some privacy.

The applicants have invented a pants liner that is readily removed from beneath an outer pair of pants, without removing the outer pants or any footwear worn by the individual, thereby requiring no privacy.

SUMMARY OF THE INVENTION

The invention is directed to a removable liner assembly worn under a pair of pants. The liner assembly has a top entry opening and a pair of foot exit openings. The removable liner assembly includes first and second separating liner members joined together. Each liner member includes a leg encircling section with one foot exit opening and a torso covering section containing a portion of the entry opening. The separating torso covering sections are joined, to form the top entry opening, by at least one separating zipper assembly, having a first zipper section (the box side) secured to the torso covering section of one liner member and a second zipper section (the pin side) secured to the torso covering section of the other liner member. A separating zipper slide member is secured to one zipper section (the box side) for engaging and disengaging the first and second zipper sections of the at least one separating zipper assembly. The separating zipper assembly also includes a pull cord member fastened to the slide member, or a pull tab member attached thereto, and anchored at the opposite end to the torso covering section, containing the zipper slide member, near the box end of the zipper assembly. The pull cord refers to a rope like device used to operate the zipper slider member or attached pull tab member for accessibility. An individual wearing the removable liner assembly with the at least one separating zipper assembly engaged, beneath a pair of pants, disengages the at least one separating zipper assembly by pulling the pull cord member from the second, anchored/fixed end thereof. Moving the zipper slide member from the stop end of the zipper assembly to the box and pin end disengages the box side from the pin side of the separating zipper assembly, thereby separating the first and second liner members. Without removing the outer pants, the individual then removes each separated liner member from within the wearer's outer pants through the foot exit openings of the outer pants, over their footwear.

In a preferred embodiment of the invention, the liner assembly has a top entry opening and a pair of foot exit openings. The removable liner assembly includes first and second separating liner members joined together. Each liner member includes a leg encircling section with one foot exit opening and a torso covering section containing a portion of the entry opening. The separating torso covering sections are joined to form the entry opening by two separating zipper assemblies in series. Each separating zipper assembly has a first zipper section (the box side) secured to the torso covering section of one liner member and a second zipper section (the pin side) secured to the torso covering section of the other liner member. A separating zipper slide member is secured to one zipper section (the box side) for engaging and disengaging the first and second zipper sections of each zipper assembly. Each zipper assembly includes a pull cord member, where one end is fastened to the zipper slide member or pull tab member, and anchored at the opposite end to the torso covering section containing the zipper slide member and attached pull tab member, near the box end of the zipper assembly. The zipper sections are disengaged with the zipper slide member moved to the anchored end of the pull cord member and are engaged with the zipper slide member moved away from the anchored/fixed end of the pull cord member.

The removable liner assembly includes a slit in the liner member's leg sections, which extends upwardly from the foot exit opening thereof. A separating zipper assembly has first and second zipper sections, with each zipper section secured to one edge of the slit in the leg section. A zipper slide member is secured to one zipper section for engaging and disengaging the first and second zipper sections of the separating zipper assembly. Each zipper assembly includes a pull cord member fastened to the zipper slide member or pull tab member and anchored at the opposite end to the leg encircling section, containing the zipper slide member or pull tab member, near the box end of the zipper assembly. The zipper sections are disengaged with the zipper slide member moved to the anchored/fixed end of the pull cord member and are engaged with the zipper slide member moved away from the anchored/fixed end of the pull cord member adjacent the foot exit opening.

An individual wearing the removable liner assembly with the two separating zipper assemblies in series at the torso covering sections engaged, beneath a pair of pants, disengages the two separating zipper assemblies by pulling the pull cord member attached to each zipper slide member or pull tab member of each zipper assembly from the anchored/fixed end thereof. The individual also disengages each separating zipper assembly in the slit extending upwardly from the foot exit opening in each leg section by pulling the pull cord member that is attached to each zipper slide member or pull tab member of each zipper assembly from the anchored/fixed end thereof. This separates the two zipper assemblies in series and thus, the first and second liner members at the torso covering sections. Separating the zipper sections in the slit of each leg section enlarges each foot exit opening. Without removing the outer pants, the individual then removes each separated liner member from within the wearer's outer pants through the foot exit openings of the outer pants, over their footwear.

BRIEF DESCRIPTION OF THE DRAWINGS

Liner with Single Zipper Assembly

Liner with Multiple Zipper Assembly

Figure 4:
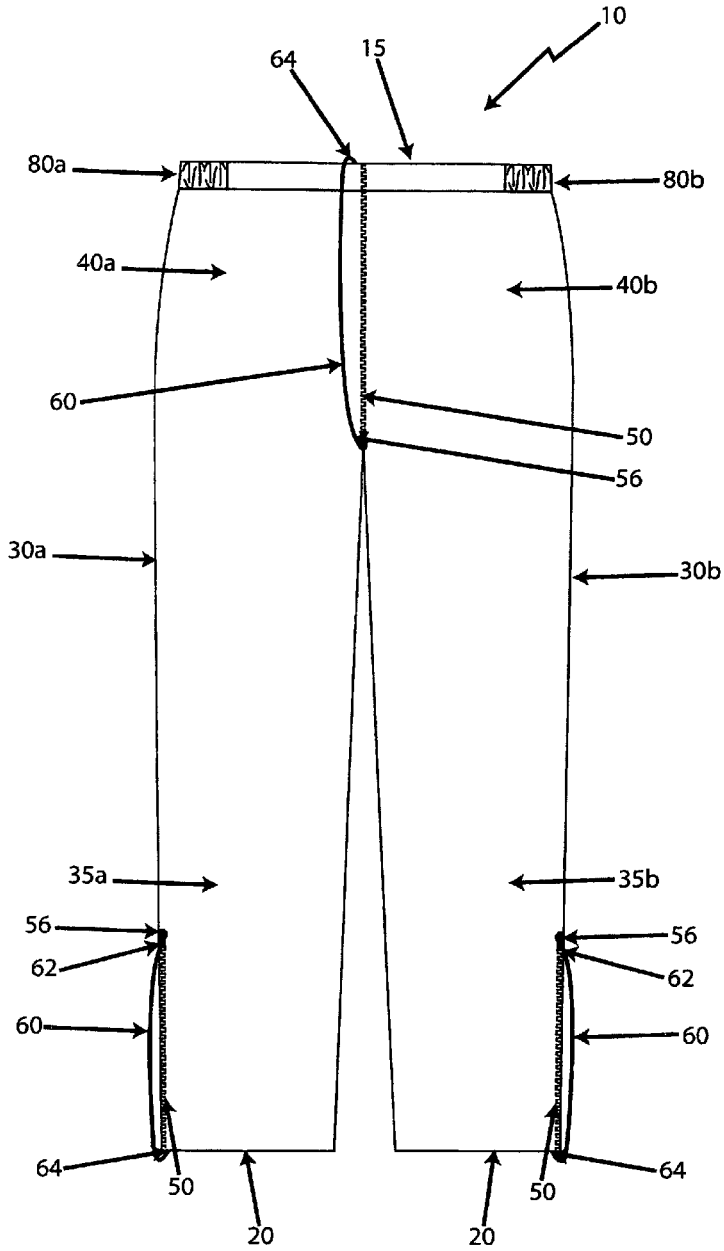

FIG. 4 is a front view of another embodiment of the removable liner assembly of the present invention with the multiple zipper assemblies engaged.

Figure 5:
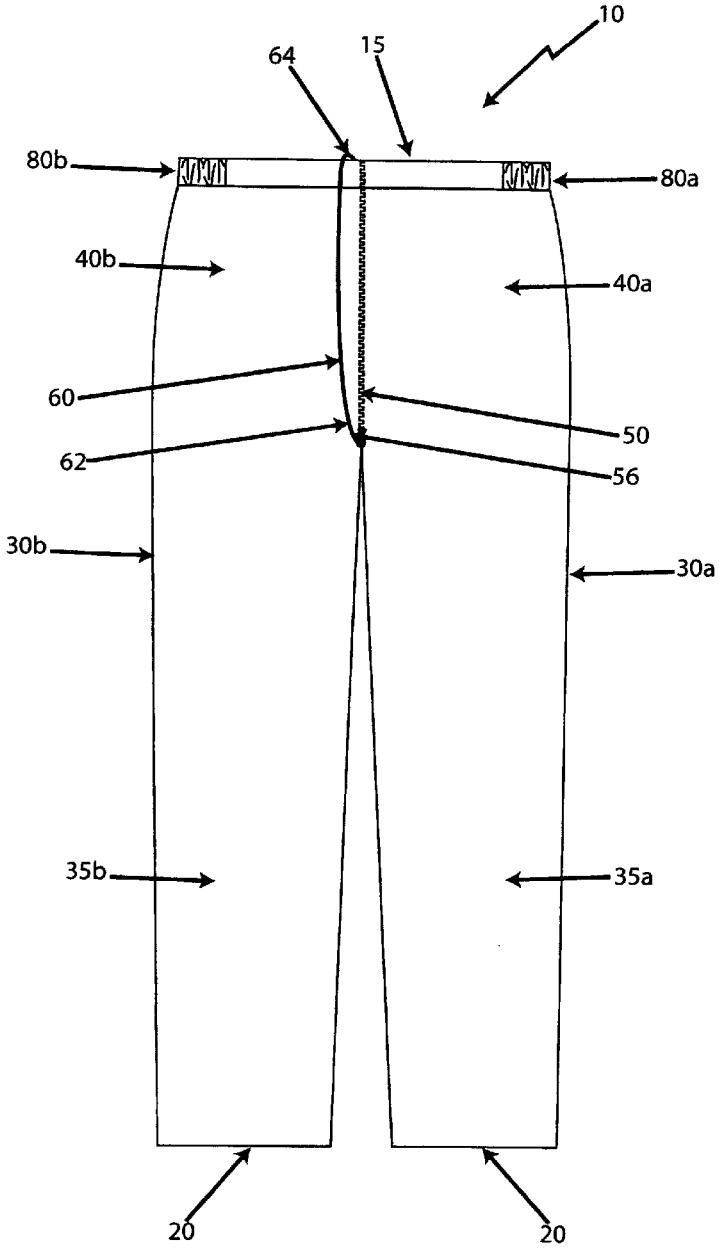

FIG. 5 is a rear view of the embodiment of FIG. 4 of the removable liner assembly of the present invention with the multiple zipper assemblies engaged.

Figure 6:
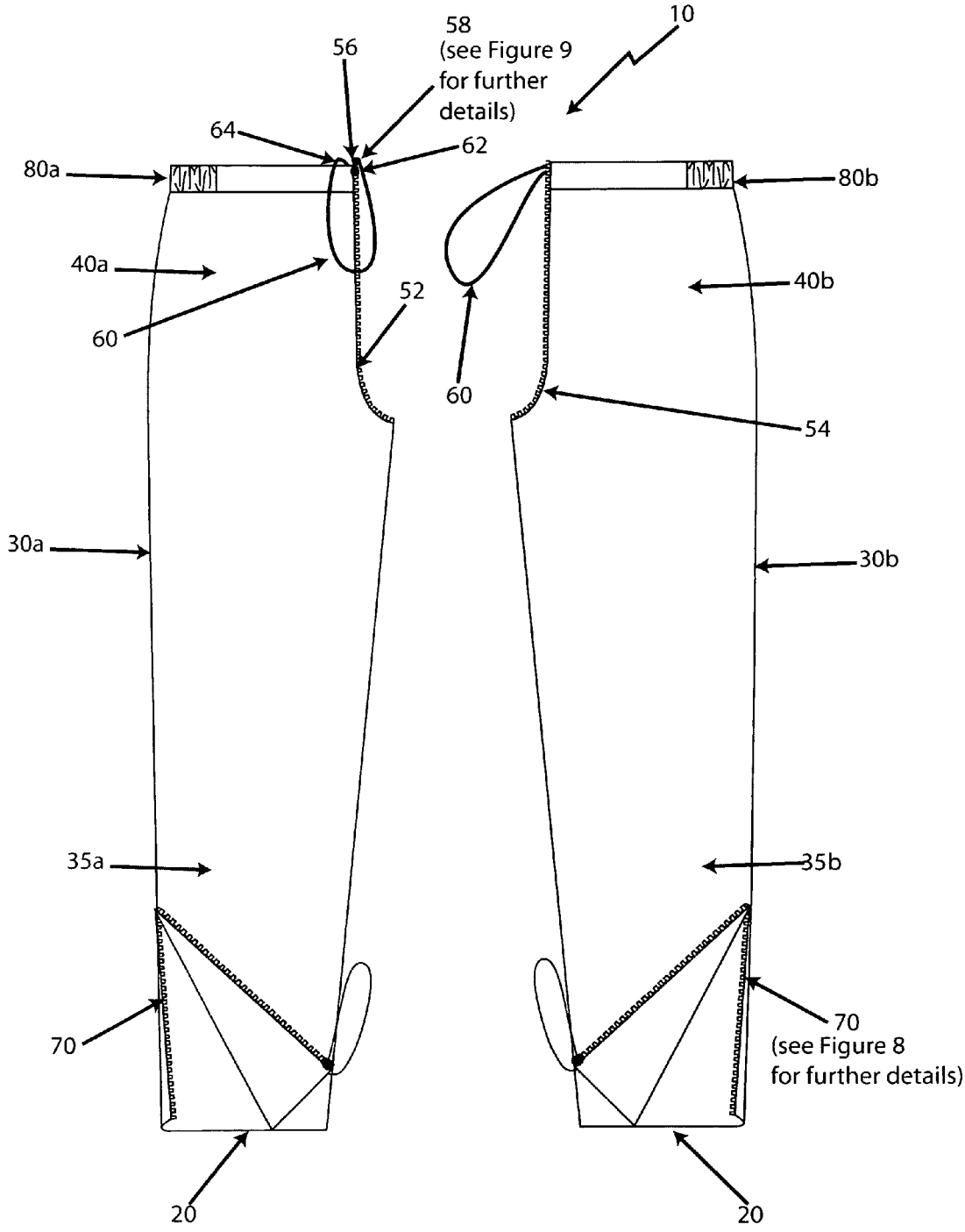

FIG. 6 is a front view of the embodiment of FIG. 4 of the removable liner assembly of the present invention with the zipper assemblies disengaged.

Liner with Multiple Zipper Assemblies, Accessories Shown

Figure 7:
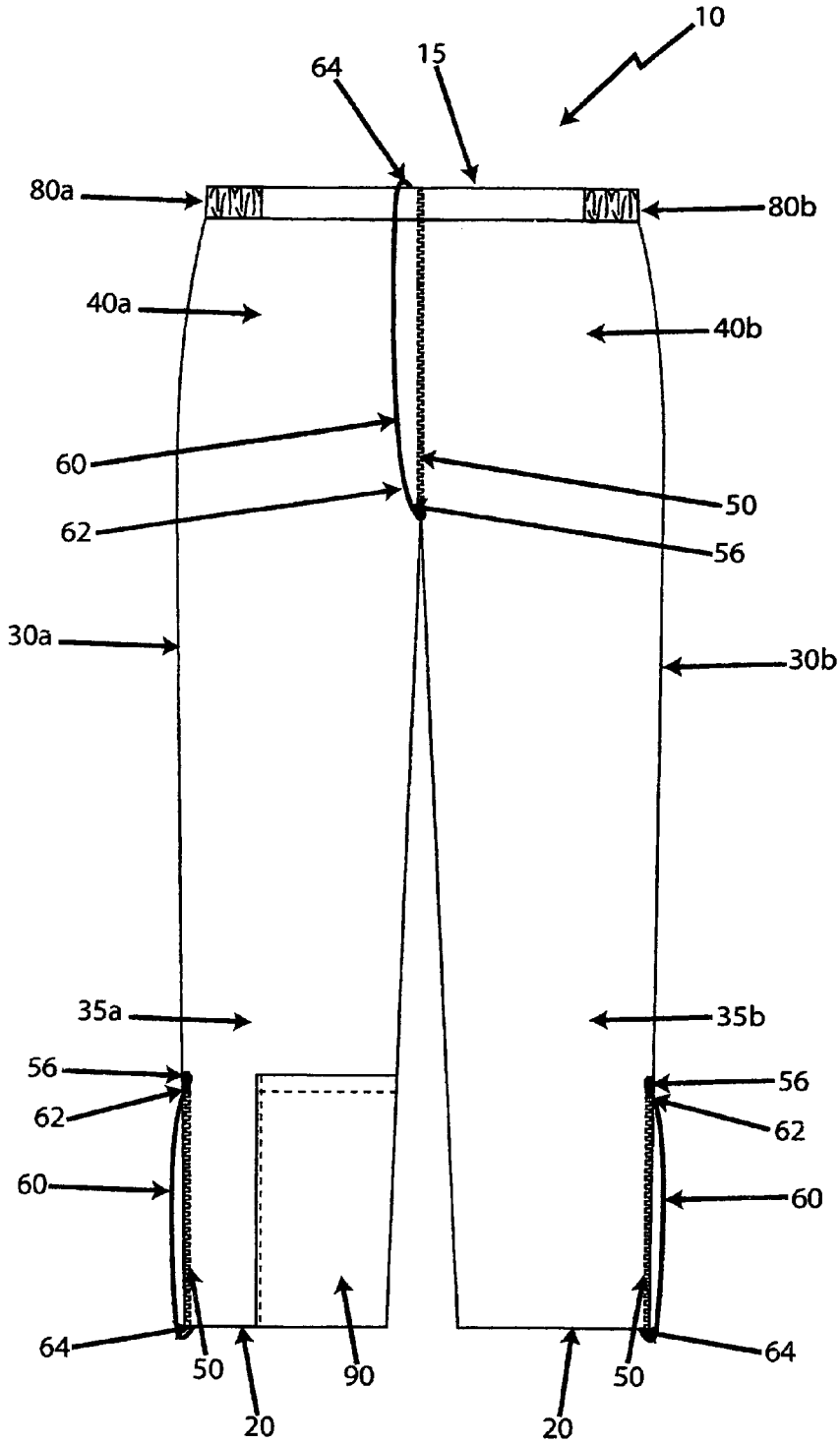

FIG. 7 is a front view of yet another embodiment of the removable liner assembly of the present invention with the zipper assemblies engaged.

Figure 8:
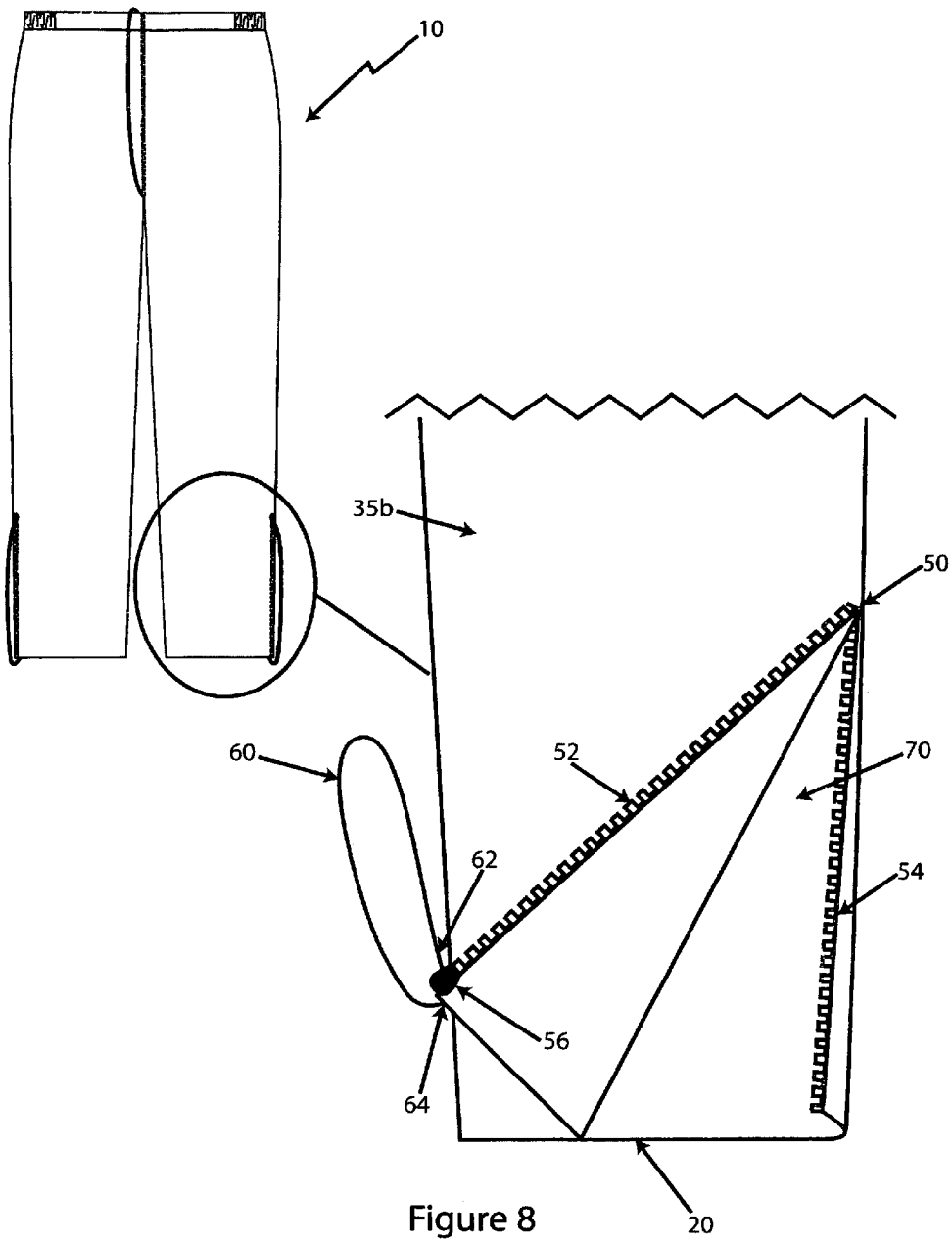

FIG. 8 is a front view of a portion of the leg encircling section of the removable liner assembly of the present invention with the zipper assembly disengaged.

Figure 9:
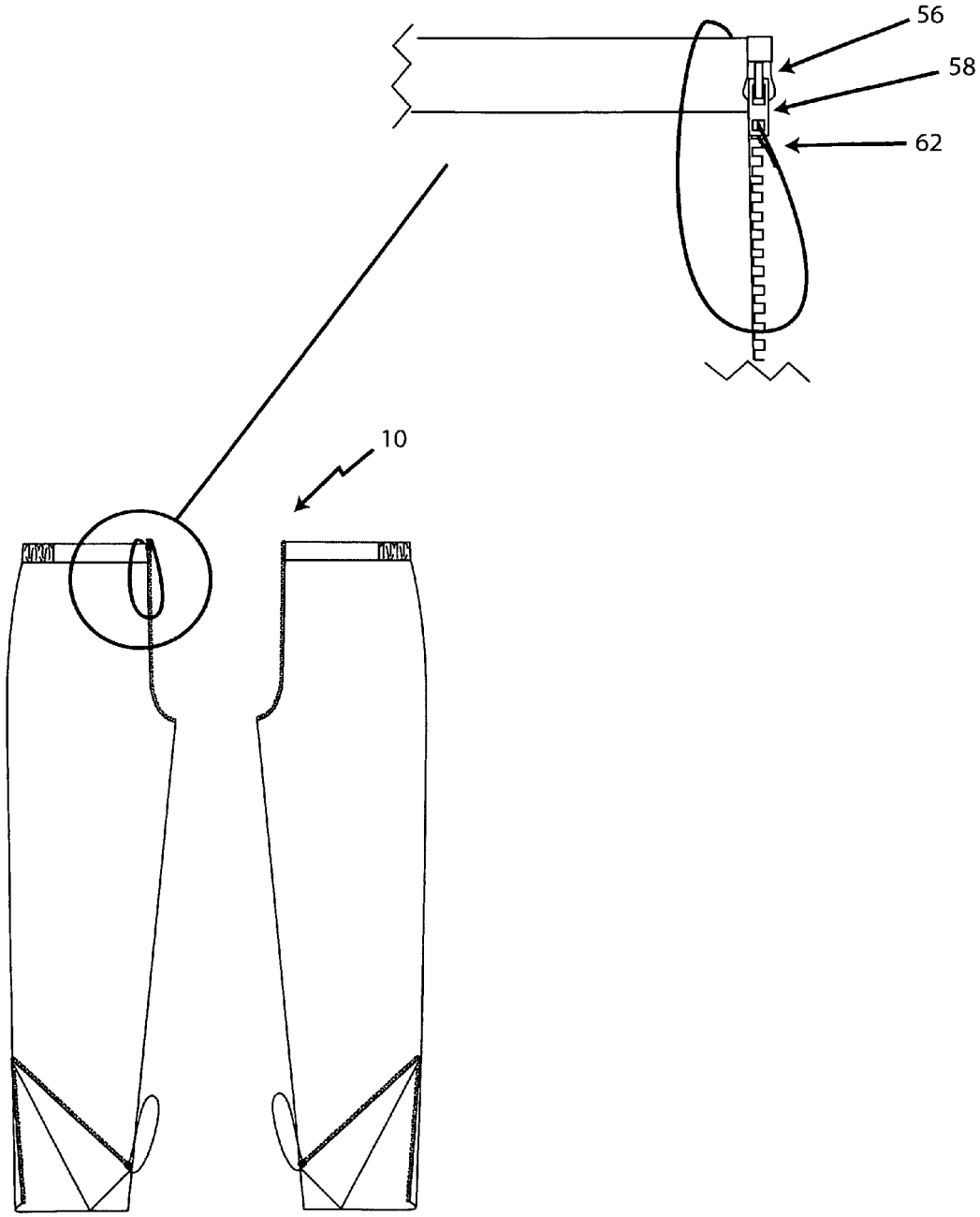

FIG. 9 is a front view of a portion of the torso covering section of the removable liner assembly of the present invention with the zipper assembly disengaged.

DESCRIPTION OF THE EMBODIMENTS

Nomenclature

| | |
|---|---|
| 10 | Removable Liner Assembly |
| 15 | Entry Opening |
| 20 | Foot Exit Openings |
| 30a | First Liner Member |
| 30b | Second Liner Member |
| 35a | Leg Encircling Section |

-continued

| | |
|---|---|
| 35b | Leg Encircling Section |
| 40a | Torso Covering Section |
| 40b | Torso Covering Section |
| 50 | Separating Zipper Assembly |
| 52 | First Zipper Section (Box Side) |
| 54 | Second Zipper Section (Pin Side) |
| 56 | Zipper Slide Member |
| 58 | Pull Tab Member |
| 60 | Pull Cord Member |
| 62 | Zipper Slide End of Pull Cord Member |
| 64 | Anchored/Fixed End of Pull Cord Member |
| 70 | Slit in Leg Section |
| 80a | Elastic Waistband Section |
| 80b | Elastic Waistband Section |
| 90 | Pocket Member |
| 100 | Stop End of Zipper Assembly |

Construction

Figure 1:
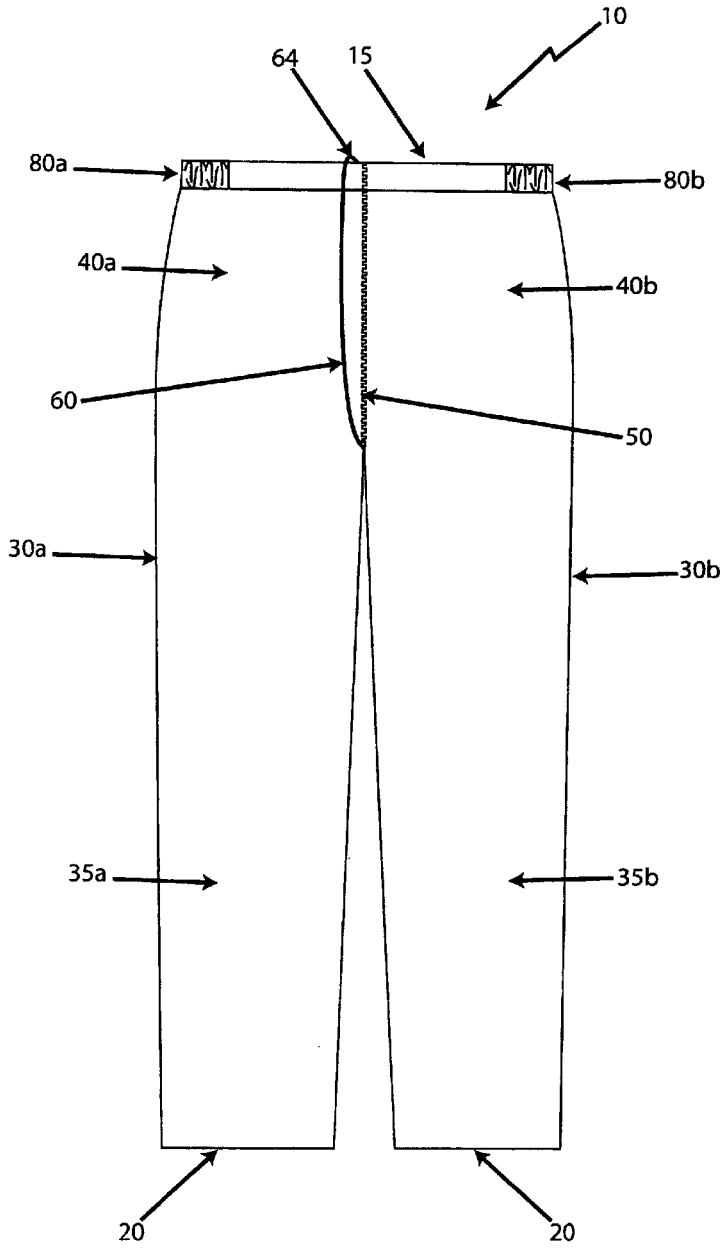
FIG. 1 is a front view of one embodiment of the removable liner assembly of the present invention with the single zipper assembly engaged.
Figure 2:
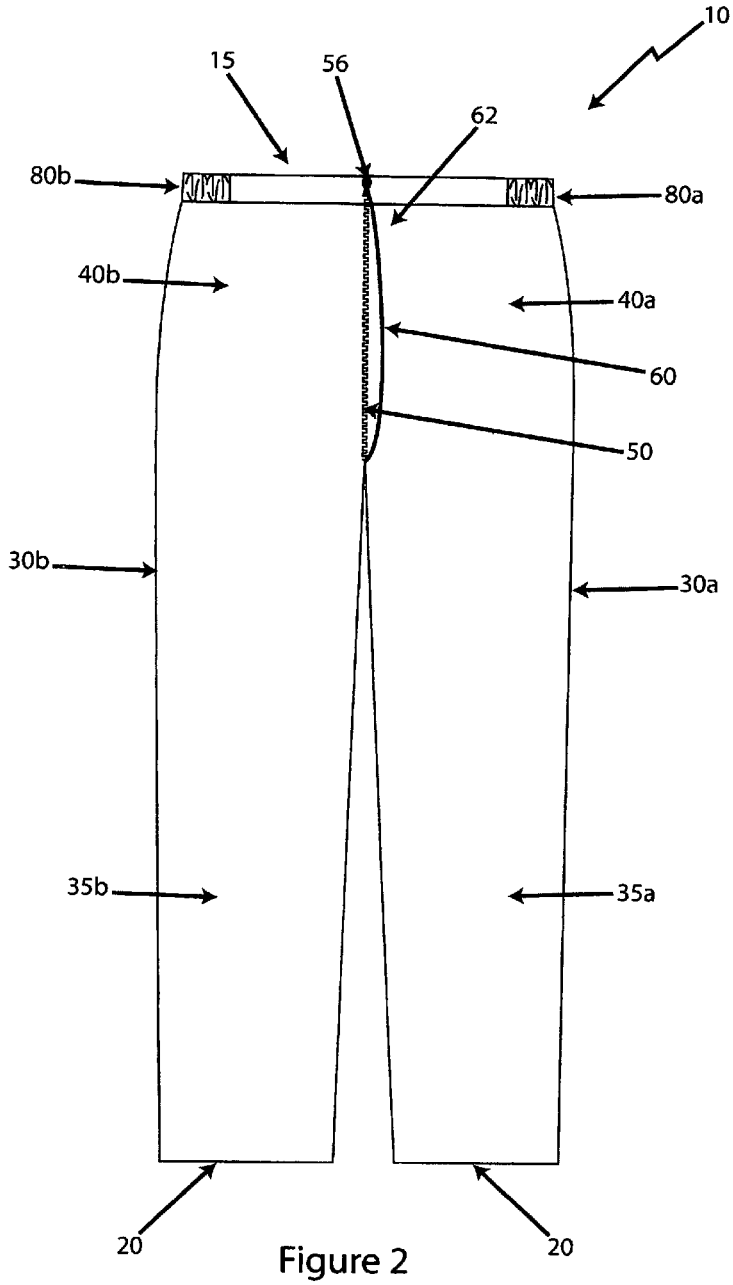
FIG. 2 is a rear view of the embodiment of FIG. 1 of the removable liner assembly of the present invention with the single zipper assembly engaged.
Figure 3:
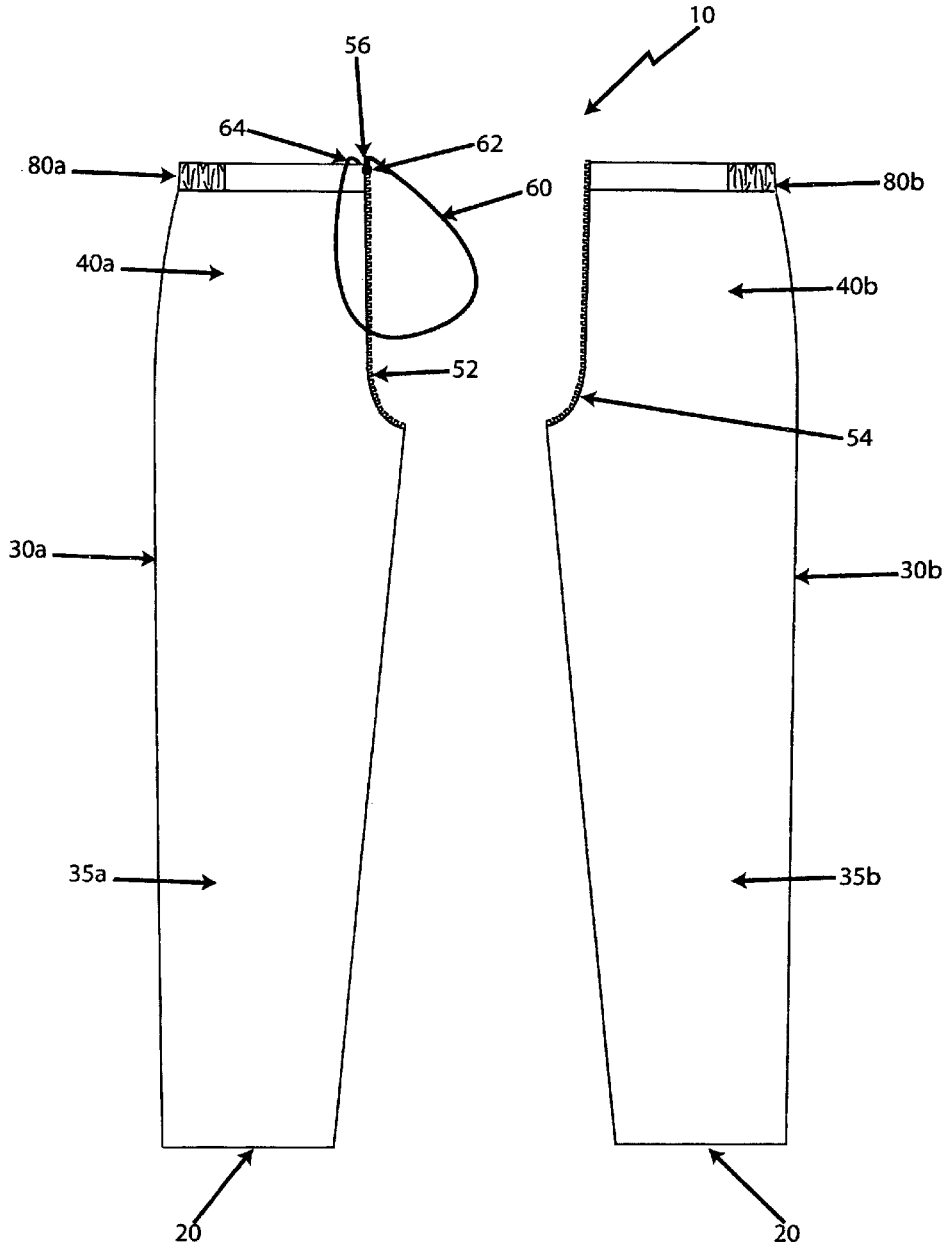
FIG. 3 is another front view of the embodiment of FIG. 1 of the removable liner assembly of the present invention with the single zipper assembly disengaged.

The invention is a removable liner assembly worn under a pair of pants. A first embodiment of the liner assembly is illustrated in FIGS. 1-3. The removable liner assembly 10 has a top entry opening 15 and a pair of foot exit openings 20. The removable liner assembly 10 includes a separating first liner member 30*a* and a second liner member 30*b*, joined together. Each liner member 30*a*, 30*b* includes a leg encircling section 35*a*, 35*b* with one foot exit opening 20 and a torso covering section 40*a*, 40*b* containing a portion of the entry opening 15. The separating torso covering sections 40*a*, 40*b* are joined to form the entry opening 15 by at least one separating zipper assembly 50, or other comparable fastening system. Each zipper assembly 50 has a first zipper section 52 (box side) secured to the torso covering section 40*a* of the first liner member 30*a* and a second zipper section 54 (pin side) secured to the torso covering section 40*b* of the second liner member 30*b*. The box and pin sides of the separating zipper assembly 50 can be fastened in reverse depending on the use of left or right handed zipper assemblies. The zipper slide member 56 is secured to one zipper section, in this case the first zipper section 52 (box side), for engaging and disengaging the first and second zipper sections 52, 54 of the at least one separating zipper assembly 50.

A pull cord member 60 is fastened at a first end 62 to the zipper slide member 56, or a pull tab member 58 attached thereto, and anchored/fixed at a second end 64 to the torso covering section (40*a* or 40*b*) near the box end of the zipper section 52 containing the zipper slide member 56. Most zipper slide members 56 include a pull tab member 58 for the user to grasp. The pull cord member 60 may be fastened/fixed to such a pull tab member 58 with equivalent results. It is imperative that both the zipper slide member 56 and the anchored second end 64 of the pull cord member 60 are contained on the same torso covering section (40*a* or 40*b*). The zipper sections 52, 54 are disengaged with the zipper slide member 56 moved to the anchored end 64 of the pull cord member 60, as in FIG. 3, and engaged with the zipper slide member 56 moved away from the anchored/fixed end 64 of the pull cord member 60, as in FIGS. 1 and 2.

An individual wearing the removable liner assembly 10 with the at least one separating zipper assembly 50 engaged, beneath a pair of pants, disengages the at least one separating zipper assembly 50 by pulling the pull cord member 60 from the second, anchored/fixed end 64 thereof. This separates the zipper sections 52, 54 and the first liner member 30*a* from the second liner member 30*b*. Without removing the outer pants, the individual then removes each separated liner member 30*a*, 30*b* from within the wearer's outer pants through the foot exit openings of the outer pants, over their footwear.

As shown in FIGS. 1-3, the anchored/fixed end 64 of the pull cord member 60 is located at the front of the removable liner assembly 10, allowing the wearer to easily grasp and pull the pull cord member 60 to separate the liner members, 30*a*, 30*b*, as shown in FIG. 3. Alternatively, the anchored/fixed end 64 of the pull cord member 60 is located at the back of the removable liner assembly 10, allowing the wearer to easily grasp and pull the pull cord member 60 to partially separate the liner members, 30*a*, 30*b*, enabling the wearer to put on the removable liner assembly 10 or use the restroom without removing the liner assembly 10. Alternatively, a two-way separating zipper assembly 50, either right or left handed, is used allowing the wearer to open the front zipper to put on the removable liner assembly 10 or use the bathroom, while still maintaining the functionality of the separating zipper assembly 50 with the pull cord member 60 anchored/fixed to the front of the removable liner assembly 10.

In a further embodiment of the invention, each torso covering section 40*a*, 40*b* includes an elastic waistband section 80*a*, 80*b*, respectively, to assist in holding the removable liner assembly 10 around the waist of the wearer.

Although the liner members 30*a*, 30*b* are illustrated as having leg encircling sections 35*a*, 35*b* that extend to the wearer's ankle, the removable liner assembly 10 can include short leg encircling sections 35*a*, 35*b* that may be worn under a pair of shorts.

Referring now to FIGS. 4 and 6, a further embodiment of the removable liner assembly 10 is illustrated. This embodiment includes a slit 70 in each liner member's leg encircling section 35*a*, 35*b* that extends upwardly from the foot exit opening 20 thereof. A separating zipper assembly 50 has a first zipper section 52 (box side) and a second zipper section 54 (pin side). Each zipper section 52, 54 is secured to one edge of the slit 70 in each of the leg encircling section 35*a*, 35*b*. A zipper slide member 56 is secured to one zipper section 52 (box side) for engaging and disengaging the first and second zipper sections 52, 54 of the separating zipper assembly 50. A pull cord member 60 is fastened at a first end 62 to the zipper slide member 56, or a pull tab member fastened thereto, and anchored/fixed at a second end 64, to the leg encircling section, (35*a* or 35*b*), near the zipper assembly's box end 52 containing the zipper slide member 56. The zipper sections 52, 54 are disengaged with the zipper slide member 56 moved to the anchored/fixed end 64 of the pull cord member 60 and engaged with the zipper slide member 56 moved away from the anchored/fixed end 64 of the pull cord member 60 that is adjacent to the foot exit opening 20. Thus, the wearer disengages the separating zipper assembly 50 by pulling the pull cord member 60 to open the slit 70 in each leg section 35*a*, 35*b*, as illustrated in FIG. 8. Opening the slit 70 enlarges the foot exit opening 20, allowing more facile removal of each liner member 30*a*, 30*b* over footwear worn by the individual.

As shown in FIGS. 4-6, a further embodiment of the removable liner assembly 10 is illustrated. In this embodiment, the separating torso covering sections 40*a*, 40*b* of each liner member 30*a*, 30*b* are joined by two separating zipper assemblies 50 positioned in series. Each separating zipper assembly 50 has a first zipper section 52 (box side) secured to the torso covering section 40*a* of the first liner member 30*a*, a second zipper section 54 (pin side) secured to the torso covering section 40*b* of the second liner member 30*b*. The box and pin sides of the separating zipper assemblies 50 can be fastened in reverse depending on the use of left or right hand zipper assemblies 50. The zipper slide member 56 is secured to one zipper section, in this case, the first zipper section 52 (box side), for engaging and disengaging the first and second zipper sections 52, 54 of each separating zipper assembly 50.

Each separating zipper assembly 50 includes a pull cord member 60 fastened at a first end 62 to the zipper slide member 56, or a pull tab member 58 fastened thereto, and anchored at a second end 64 to the torso covering section (40*a* or 40*b*) near the box end of the zipper section 52 containing the zipper slide member 56. Most zipper slide members 56 include a pull tab member 58 for the user to grasp. The pull cord member 60 may be fastened to such a pull tab member 58 with equivalent results. It is imperative that both the zipper slide members 56 and the anchored/fixed end 64 of the pull cord members 60 are contained on the same torso covering section (40*a* or 40*b*).

The zipper sections 52, 54 of each separating zipper assembly 50 are disengaged with the zipper slide member 56 moved to the anchored/fixed end 64 of the pull cord member 60, as in FIG. 6. The zipper sections 52, 54 of each separating zipper assembly 50 are engaged with the zipper slide member 56 moved away from anchored/fixed end 64 of the pull cord member 60, as in FIGS. 4 and 5. An individual wearing the removable liner assembly 10 with the two separating zipper assemblies 50 engaged, beneath a pair of pants, disengages the two separating zipper assemblies 50 by pulling the pull cord members 60 from the second, anchored/fixed end 64 thereof. This separates the zipper sections 52, 54 and the first liner member 30*a* from the second liner member 30*b*. Without removing the outer pants, the individual then removes each separated liner member 30*a*, 30*b* from within the wearer's outer pants through the foot exit openings of the outer pants, over their footwear.

In a preferred embodiment of the invention, each pull cord member 60 is anchored at a second end 64 to the torso covering section (40*a* or 40*b*) near the box end of the zipper section containing the zipper slide member 56, adjacent the entry opening 15 of the liner assembly 10, as in FIGS. 4-6. Thus, the wearer has facile access to each anchored second end 64 of the pull cord member 60 to disengage the two separating zipper assemblies 50 fastening the two liner members 30*a*, 30*b* together. Alternatively, a two-way separating zipper assembly 50, either right or left handed, is used in place of the front separating zipper assembly 50 allowing the wearer to open the front zipper to put on the removable liner assembly 10 or use the bathroom while still maintaining the functionality of the separating zipper with pull cord member 60 anchored/fixed to the front of the removable liner assembly 10.

As indicated for the embodiment of the invention shown in FIGS. 1-3, although the liner members 30*a*, 30*b* are illustrated as having leg encircling sections 35*a*, 35*b* that extend to the wearer's ankle, the liner assembly 10 can include short leg encircling sections 35*a*, 35*b* that may be worn under a pair of shorts.

In a further embodiment of the invention, a pocket member 90 is attached to a surface of the first liner member 30*a*, as shown in FIG. 7. The pocket member 90 is adapted for containing the adjacent liner member 30*b* and a portion of the liner member 30*a* to which the pocket member 90 is attached. Once the liner members 30*a*, 30*b* are removed by the wearer, the adjacent liner member 30*b* is folded or rolled up and inserted into the pocket member 90 on the first liner member 30*a* to which the pocket member 90 is attached. Likewise, the majority of the first liner member 30*a* is folded or rolled up and inserted into the pocket member 90, producing a compact unit that is readily stored or transported.

Preferably, the first and second liner members 30*a*, 30*b* are fabricated from a material with a smooth, slick or slippery exterior surface having low friction characteristics. The low friction exterior of each liner member 30*a*, 30*b* assists in removing each liner member from inside the outer pants of the wearer.

Preferably, the first and second liner members 30*a*, 30*b* are fabricated from an insulating material. A wide variety of materials having insulating characteristics are available. Thus, the liner assembly 10 provides warmth from the cold.

While the invention has been particularly shown and described with reference to preferred embodiments thereof, it will be understood by those skilled in the art that various changes in form and details may be made therein without departing from the spirit and scope of the invention.

We claim:

1. A removable liner assembly for a pair of pants on a wearer comprising:

a separating liner assembly having a top entry opening and a pair of foot exit openings, the separating liner assembly including;

first and second separating liner members joined together, each liner member including a leg encircling section with one foot exit opening and a separating torso covering section containing a portion of the entry opening, the separating torso covering sections joined to form the entry opening by two separating zipper assemblies in series, each separating zipper assembly having a first zipper section secured to the torso covering section of one liner member, a second zipper section secured to the torso covering section of the other liner member, and a zipper slide member secured to one zipper section for engaging and disengaging the first and second zipper sections of each separating zipper assembly; and each zipper assembly including a pull cord member fastened at a first end to the zipper slide member and anchored at a second end to the torso covering section having the one zipper section containing the zipper slide member, adjacent the entry opening of the separating liner assembly, the zipper sections disengaged with the zipper slide member moved to the second, anchored end of the pull cord member and engaged with the zipper slide member moved away from the second, anchored end of the pull cord member;

whereby an individual wearing the removable liner assembly with the two separating zipper assemblies engaged, beneath a pair of pants, disengages each separating zipper assembly by pulling the pull cord member from the second, anchored end thereof, thereby separating the zipper sections and the first and second liner members, and removes each liner member from within the pants through a foot exit opening thereof.

2. The removable liner assembly for a pair of pants of claim 1, wherein the pull cord member is fastened at a first end to the zipper slide member via a pull tab member.

3. The removable liner assembly for a pair of pants of claim 1, further including a slit in a liner member's leg encircling section extending upwardly from the foot exit opening thereof, and a separating zipper assembly having first and second zipper sections, each zipper section secured to one edge of the slit in the leg section, and a zipper slide member secured to one zipper section for engaging and disengaging the first and second zipper sections of the separating zipper assembly; and a pull cord member fastened at a first end to the zipper slide member and anchored at a second end to the leg encircling section near the one zipper section containing the zipper slide member and adjacent the foot exit opening, the zipper sections disengaged with the zipper slide member moved to the second, anchored end of the pull cord member and engaged with the zipper slide member moved away from the second, anchored end of the pull cord member adjacent the foot exit opening.

4. The removable liner assembly for a pair of pants of claim 1, wherein the at least one zipper assembly is selected from the group consisting of a right hand separating zipper assembly, a left hand separating zipper assembly, a right hand two-way separating zipper assembly and a left hand two-way separating zipper assembly.

5. The removable liner assembly for a pair of pants of claim 1, further including an elastic waistband section secured to each liner member at the portion of the entry opening of each separating torso covering section.

6. The removable liner assembly for a pair of pants of claim 1, further including a pocket member attached to a surface of the first liner member, the pocket member adapted for containing the second liner member and a portion of the first liner member.

7. The removable liner assembly for a pair of pants of claim 1, wherein the first and second liner members are fabricated from a material with a low friction, exterior surface, thereby assisting in removal of each liner member from inside the outer pair of pants on the wearer.

8. The removable liner assembly for a pair of pants of claim 1, wherein the first and second liner members are fabricated from an insulating material, thereby providing warmth from the cold.

9. A removable liner assembly for a pair of pants on a wearer comprising:

a separating liner assembly having a top entry opening and a pair of foot exit openings, the separating liner assembly including;

first and second separating liner members joined together, each liner member including a leg encircling section with one foot exit opening and a separating torso covering section containing a portion of the entry opening, the separating torso covering sections joined to form the entry opening by two separating zipper assemblies in series, each zipper assembly having a first zipper section secured to the torso covering section of the first liner member, a second zipper section secured to the torso covering section of the second liner member, and a zipper slide member secured to one zipper section for engaging and disengaging the first and second zipper sections of each zipper assembly; and each zipper assembly including a pull cord member fastened at a first end to the zipper slide member and anchored at a second end to the torso covering section containing the zipper slide member, the zipper sections disengaged with the zipper slide member moved to the second, anchored end of the pull cord member and engaged with the zipper slide member moved away from the second, anchored end of the pull cord member;

whereby an individual wearing the removable liner assembly with the two separating zipper assemblies in series engaged, beneath a pair of pants, disengages the two separating zipper assemblies by pulling the pull cord member of each zipper assembly from the second, anchored end thereof, thereby separating the zipper sections and the first and second liner members, and removes each liner member from within the pants through a foot exit opening thereof.

10. The removable liner assembly for a pair of pants of claim 9, wherein the pull cord member is fastened at a first end to the zipper slide member via a pull tab member.

11. The removable liner assembly for a pair of pants of claim 9, wherein each pull cord member is anchored at a second end to the torso covering section containing the zipper slide member, adjacent the entry opening of the separating liner assembly.

12. The removable liner assembly for a pair of pants of claim 9, further including a slit in a liner member's leg encircling section extending upwardly from the foot exit opening thereof, and a separating zipper assembly having first and second zipper sections, each zipper section secured to one edge of the slit in the leg section, and a zipper slide member secured to one zipper section for engaging and disengaging the first and second zipper sections of the separating zipper assembly; and a pull cord member fastened at a first end to the zipper slide member and anchored at a second end to the leg encircling section near the one zipper section containing the zipper slide member and adjacent the foot exit opening, the zipper sections disengaged with the zipper slide member moved to the second, anchored end of the pull cord member and engaged with the zipper slide member moved away from the second, anchored end of the pull cord member adjacent the foot exit opening.

13. The removable liner assembly for a pair of pants of claim 9, wherein each of the two zipper assemblies in series is selected from the group consisting of a right hand separating zipper assembly, a left hand separating zipper assembly, a right hand two-way separating zipper assembly and a left hand-two way separating zipper assembly.

14. The removable liner assembly for a pair of pants of claim 9, further including an elastic waistband section secured to each liner member at the portion of the entry opening of each separating torso covering section.

15. The removable liner assembly for a pair of pants of claim 9, further including a pocket member attached to a surface of the first liner member, the pocket member adapted for containing the second liner member and a portion of the first liner member.

16. The removable liner assembly for a pair of pants of claim 9, wherein the first and second liner members are fabricated from a material with a low friction, exterior surface, thereby assisting in removal of each liner member from inside the outer pair of pants on the wearer.

17. The removable liner assembly for a pair of pants of claim 9, wherein the first and second liner members are fabricated from an insulating material, thereby providing warmth from the cold.

18. A removable liner assembly for a pair of pants on a wearer comprising:

a separating liner assembly having a top entry opening and a pair of foot exit openings, the separating liner assembly including;

first and second separating liner members joined together, each liner member including a leg encircling section with one foot exit opening and a separating torso covering section containing a portion of the entry opening, the separating torso covering sections joined to form the entry opening by two separating zipper assemblies in series, each zipper assembly having a first zipper section secured to the torso covering section of the first liner member, a second zipper section secured to the torso covering section of the second liner member, and a zipper slide member secured to one zipper section for engaging and disengaging the first and second zipper sections of each zipper assembly;

each zipper assembly including a pull cord member fastened at a first end to the zipper slide member and anchored at a second end to the torso covering section containing the zipper slide member, the zipper sections disengaged with the zipper slide member moved to the second, anchored end of the pull cord member and engaged with the zipper slide member moved away from the second, anchored end of the pull cord member; and a slit in a liner member's leg section extending upwardly from the foot exit opening thereof, and a separating zipper assembly having first and second zipper sections, each zipper section secured to one edge of the slit in the leg section, and a zipper slide member secured to one zipper section for engaging and disengaging the first and second zipper sections of the separating zipper assembly; and a pull cord member fastened at a first end to the zipper slide member and anchored at a second end to the leg encircling section near the one zipper section containing the zipper slide member and adjacent the foot exit opening, the zipper sections disengaged with the zipper slide member moved to the second, anchored end of the pull cord member and engaged with the zipper slide member moved away from the second, anchored end of the pull cord member adjacent the foot exit opening;

whereby an individual wearing the removable liner assembly with the two separating zipper assemblies in series at the torso covering sections engaged, beneath a pair of pants, disengages the two separating zipper assemblies by pulling the pull cord member of each zipper assembly from the second, anchored end thereof, and disengages each separating zipper assembly in the slit extending upwardly from the foot exit opening in each leg section by pulling the pull cord member of each zipper assembly from the second, anchored end thereof, thereby separating the zipper sections and the first and second liner members, separating the zipper sections in the slit of each leg section, and removes each liner member from within the pants through a foot exit opening thereof.

19. The removable liner assembly for a pair of pants of claim 18, wherein the pull cord member is fastened at a first end to the zipper slide member via a pull tab member.

20. The removable liner assembly for a pair of pants of claim 18, wherein each pull cord member of the two separating zipper assemblies in series at the separating torso covering sections, is anchored at a second end to the torso covering section containing the zipper slide member, adjacent the entry opening of the separating liner assembly.

21. The removable liner assembly for a pair of pants of claim 18, wherein each of the two zipper assemblies in series is selected from the group consisting of a right hand separating zipper assembly, a left hand separating zipper assembly, a right hand two-way separating zipper assembly and a left hand-two way separating zipper assembly.

22. The removable liner assembly for a pair of pants of claim 18, further including an elastic waistband section secured to each liner member at the portion of the entry opening of each torso covering section.

23. The removable liner assembly for a pair of pants of claim 18, further including a pocket member attached to a surface of the first liner member, the pocket member adapted for containing the second liner member and a portion of the first liner member.

24. The removable liner assembly for a pair of pants of claim 18, wherein the first and second liner members are fabricated from a material with a low friction, exterior surface, thereby assisting in removal of each liner member from inside the outer pair of pants on the wearer.

25. The removable liner assembly for a pair of pants of claim 18, wherein the first and second liner members are fabricated from an insulating material, thereby providing warmth from the cold.

* * * * *